US010145388B2

(12) United States Patent
Simmonds et al.

(10) Patent No.: US 10,145,388 B2
(45) **Date of Patent: *Dec. 4, 2018**

(54) FAN WITH A FILTER

(71) Applicant: Dyson Technology Limited, Wiltshire (GB)

(72) Inventors: Kevin John Simmonds, Bath (GB); Nicholas Gerald Fitton, Swindon (GB); Frederic Nicolas, Swindon (GB); Peter David Gammack, Gloucester (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 136 days.

This patent is subject to a terminal disclaimer.

(21) Appl. No.: 15/420,057

(22) Filed: Jan. 30, 2017

(65) Prior Publication Data

US 2017/0138374 A1 May 18, 2017

Related U.S. Application Data

(63) Continuation of application No. 13/125,742, filed as application No. PCT/GB2009/051401 on Oct. 19, 2009, now Pat. No. 9,816,531.

(30) Foreign Application Priority Data

Oct. 25, 2008 (GB) ..... 0819612.3

(51) Int. Cl.
*F04D 29/54* (2006.01)
*F04D 29/70* (2006.01)
(Continued)

(52) U.S. Cl.
CPC ..... *F04D 29/703* (2013.01); *F04D 25/08* (2013.01); *F04D 29/403* (2013.01);
(Continued)

(58) Field of Classification Search
CPC ..... F04D 29/403; F04F 5/16
See application file for complete search history.

(56) References Cited

U.S. PATENT DOCUMENTS 1,357,261 A 11/1920 Svoboda
1,767,060 A 6/1930 Ferguson
(Continued)

FOREIGN PATENT DOCUMENTS

BE 560119 8/1957
CA 1055344 5/1979
(Continued)

OTHER PUBLICATIONS

US 6,102,988, 08/2000, Tang et al. (withdrawn)
(Continued)

*Primary Examiner* — Woody Lee, Jr.
(74) *Attorney, Agent, or Firm* — Morrison & Foerster LLP

(57) ABSTRACT

A fan assembly for creating an air current is described, the fan assembly having a nozzle, a system for creating an air flow through the nozzle and a filter for removing particulates from the air flow, the nozzle having an interior passage, a mouth for receiving the air flow from the interior passage, and a Coanda surface located adjacent the mouth and over which the mouth is arranged to direct the air flow, wherein the fan provides an arrangement producing an air current and a flow of cooling air created without requiring a bladed fan, i.e. air flow is created by a bladeless fan.

15 Claims, 8 Drawing Sheets

(51) Int. Cl.
*F04D 25/08* (2006.01)
*F04D 29/40* (2006.01)
*F04F 5/16* (2006.01)

(52) U.S. Cl.
CPC ..... *F04D 29/545* (2013.01); *F04F 5/16* (2013.01); *Y10T 137/2224* (2015.04)

(56) References Cited

U.S. PATENT DOCUMENTS 1,819,498 A 8/1931 Cole
1,896,869 A 2/1933 Larsh
2,014,185 A 9/1935 Martin
2,035,733 A 3/1936 Wall
D103,476 S 3/1937 Weber
2,115,883 A 5/1938 Sher
D115,344 S 6/1939 Chapman
2,210,458 A 8/1940 Keilholtz
2,258,961 A 10/1941 Saathoff
2,336,295 A 12/1943 Reimuller
2,362,933 A * 11/1944 Schaefer ..... F24F 3/16 422/4
2,394,923 A 2/1946 Little
2,433,795 A 12/1947 Stokes
2,473,325 A 6/1949 Aufiero
2,476,002 A 7/1949 Stalker
2,488,467 A 11/1949 De Lisio
2,510,132 A 6/1950 Morrison
2,544,379 A 3/1951 Davenport
2,547,448 A 4/1951 Demuth
2,583,374 A 1/1952 Hoffman
2,620,127 A 12/1952 Radcliffe
2,765,977 A 10/1956 Morrison
2,808,198 A 10/1957 Morrison
2,813,673 A 11/1957 Smith
2,830,779 A 4/1958 Wentling
2,838,229 A 6/1958 Belanger
2,922,277 A 1/1960 Bertin
2,922,570 A 1/1960 Allen
3,004,403 A 10/1961 Laporte
3,046,732 A * 7/1962 Foa ..... F04D 17/18 104/134
3,047,208 A 7/1962 Coanda
3,270,655 A 9/1966 Guirl et al.
3,271,936 A 9/1966 Dauge
D206,973 S 2/1967 De Lisio
3,503,138 A 3/1970 Fuchs et al.
3,518,776 A 7/1970 Wolff et al.
3,724,092 A 4/1973 McCleerey
3,743,186 A 7/1973 Mocarski
3,795,367 A 3/1974 Mocarski
3,850,598 A 11/1974 Boehm
3,871,847 A 3/1975 Fish
3,872,916 A 3/1975 Beck
3,875,745 A 4/1975 Franklin
3,885,891 A * 5/1975 Throndson ..... F04F 5/16 417/196
3,937,192 A * 2/1976 Longhouse ..... F01P 5/06 123/41.49
3,943,329 A 3/1976 Hlavac
4,037,991 A 7/1977 Taylor
4,046,492 A 9/1977 Inglis
4,061,188 A 12/1977 Beck
4,073,613 A 2/1978 Desty
4,113,416 A 9/1978 Kataoka et al.
4,136,735 A 1/1979 Beck et al.
4,173,995 A 11/1979 Beck
4,180,130 A 12/1979 Beck et al.
4,184,541 A 1/1980 Beck et al.
4,192,461 A * 3/1980 Arborg ..... B63H 11/02 114/151
4,332,529 A 6/1982 Alperin
4,336,017 A 6/1982 Desty
4,342,204 A 8/1982 Melikian et al.
4,371,322 A * 2/1983 Lorraine ..... F01N 3/32 418/47
4,448,354 A 5/1984 Reznick et al.
4,477,270 A * 10/1984 Tauch ..... B01D 46/0024 55/318
4,566,852 A * 1/1986 Hauser ..... B01D 53/005 123/41.49
4,568,243 A 2/1986 Schubert et al.
4,630,475 A 12/1986 Mizoguchi
4,643,351 A 2/1987 Fukamachi et al.
4,703,152 A 10/1987 Shih-Chin
4,718,870 A 1/1988 Watts
4,732,539 A 3/1988 Shin-Chin
4,790,133 A 12/1988 Stuart
4,850,804 A 7/1989 Huang
4,878,620 A 11/1989 Tarleton
4,893,990 A 1/1990 Tomohiro et al.
4,905,340 A 3/1990 Gutschmit
4,978,281 A 12/1990 Conger
5,022,900 A 6/1991 Bar-Yona et al.
5,061,405 A 10/1991 Stanek et al.
5,094,676 A 3/1992 Karbacher
D325,435 S 4/1992 Coup et al.
5,168,722 A 12/1992 Brock
5,176,856 A 1/1993 Takahashi et al.
5,188,508 A 2/1993 Scott et al.
5,266,004 A 11/1993 Tsumarai et al.
5,266,090 A 11/1993 Burnett
5,296,769 A 3/1994 Havens et al.
5,310,313 A 5/1994 Chen
5,317,815 A 6/1994 Hwang
5,358,443 A * 10/1994 Mitchell ..... F24F 3/1603 454/230
5,402,938 A 4/1995 Sweeney
5,407,324 A 4/1995 Starnes, Jr. et al.
5,425,902 A 6/1995 Miller et al.
5,435,817 A 7/1995 Davis et al.
5,518,370 A 5/1996 Wang et al.
5,588,985 A 12/1996 Shagott et al.
5,609,473 A 3/1997 Litvin
5,641,343 A 6/1997 Frey
5,645,769 A 7/1997 Tamaru et al.
5,649,370 A 7/1997 Russo
5,735,683 A 4/1998 Muschelknautz
5,753,000 A 5/1998 Chiu et al.
5,762,034 A * 6/1998 Foss ..... F01P 5/06 123/41.49
5,762,661 A 6/1998 Kleinberger et al.
5,783,117 A 7/1998 Byassee et al.
D398,983 S 9/1998 Keller et al.
5,837,020 A * 11/1998 Cartellone ..... B01D 46/24 55/459.3
5,841,080 A 11/1998 Iida et al.
5,843,344 A 12/1998 Junket et al.
5,862,037 A 1/1999 Behl
5,868,197 A 2/1999 Potier
5,881,685 A 3/1999 Foss et al.
D415,271 S 10/1999 Feer
5,997,619 A 12/1999 Knuth et al.
6,001,145 A 12/1999 Hammes
6,015,274 A 1/2000 Bias et al.
6,053,968 A 4/2000 Miller
6,073,881 A 6/2000 Chen
D429,808 S 8/2000 Krauss et al.
6,123,618 A 9/2000 Day
6,155,782 A 12/2000 Hsu
6,156,085 A 12/2000 Chiu et al.
D435,899 S 1/2001 Melwani
6,197,096 B1 * 3/2001 Cartellone ..... A47L 9/125 15/353
6,217,281 B1 4/2001 Jeng et al.
6,254,337 B1 7/2001 Arnold
6,269,549 B1 8/2001 Carlucci et al.
6,278,248 B1 8/2001 Hong et al.
6,282,746 B1 9/2001 Schleeter
6,293,121 B1 9/2001 Labrador
6,321,034 B2 11/2001 Jones-Lawlor et al.
6,386,845 B1 5/2002 Bedard
6,480,672 B1 11/2002 Rosenzweig et al.

(56) References Cited

U.S. PATENT DOCUMENTS

| | | | | |
|---|---|---|---|---|
| 6,511,531 | B1 * | 1/2003 | Cartellone | A61L 9/03 261/142 |
| 6,599,088 | B2 | 7/2003 | Stagg | |
| 6,616,722 | B1 | 9/2003 | Cartellone | |
| D485,895 | S | 1/2004 | Melwani | |
| 6,789,787 | B2 | 9/2004 | Stutts | |
| 6,830,433 | B2 | 12/2004 | Birdsell et al. | |
| 6,834,412 | B2 | 12/2004 | Stanovich et al. | |
| 7,059,826 | B2 | 6/2006 | Lasko | |
| 7,088,913 | B1 | 8/2006 | Verhoorn et al. | |
| 7,112,232 | B2 | 9/2006 | Chang et al. | |
| 7,147,336 | B1 | 12/2006 | Chou | |
| D539,414 | S | 3/2007 | Russak et al. | |
| 7,320,721 | B2 | 1/2008 | Ham et al. | |
| 7,478,993 | B2 | 1/2009 | Hong et al. | |
| 7,540,474 | B1 | 6/2009 | Huang et al. | |
| D598,532 | S | 8/2009 | Dyson et al. | |
| D602,143 | S | 10/2009 | Gammack et al. | |
| D602,144 | S | 10/2009 | Dyson et al. | |
| D605,748 | S | 12/2009 | Gammack et al. | |
| 7,664,377 | B2 | 2/2010 | Liao | |
| D614,280 | S | 4/2010 | Dyson et al. | |
| 7,775,848 | B1 | 8/2010 | Auerbach | |
| 7,806,388 | B2 | 10/2010 | Junkel et al. | |
| 7,931,449 | B2 * | 4/2011 | Fitton | F04D 25/08 417/198 |
| 8,092,166 | B2 * | 1/2012 | Nicolas | F04D 25/08 415/209.2 |
| 8,366,403 | B2 * | 2/2013 | Wallace | F04D 25/08 415/126 |
| 8,764,412 | B2 * | 7/2014 | Gammack | F04D 25/06 239/434.5 |
| 8,770,946 | B2 * | 7/2014 | Fitton | F04F 5/16 239/265.17 |
| 2002/0106547 | A1 | 8/2002 | Sugawara et al. | |
| 2003/0059307 | A1 | 3/2003 | Moreno et al. | |
| 2003/0171093 | A1 | 9/2003 | Gumucio Del Pozo | |
| 2004/0022631 | A1 | 2/2004 | Birdsell et al. | |
| 2004/0049842 | A1 | 3/2004 | Prehodka | |
| 2004/0118093 | A1 | 6/2004 | Chang et al. | |
| 2004/0149881 | A1 | 8/2004 | Allen | |
| 2005/0031448 | A1 | 2/2005 | Lasko et al. | |
| 2005/0053465 | A1 | 3/2005 | Roach et al. | |
| 2005/0069407 | A1 | 3/2005 | Winkler et al. | |
| 2005/0128698 | A1 | 6/2005 | Huang | |
| 2005/0163670 | A1 | 7/2005 | Alleyne et al. | |
| 2005/0173997 | A1 | 8/2005 | Schmid et al. | |
| 2005/0281672 | A1 | 12/2005 | Parker et al. | |
| 2006/0096863 | A1 | 5/2006 | Yamazaki et al. | |
| 2006/0172682 | A1 | 8/2006 | Orr et al. | |
| 2006/0199515 | A1 | 9/2006 | Lasko et al. | |
| 2006/0201119 | A1 | 9/2006 | Song | |
| 2006/0260282 | A1 | 11/2006 | Peng | |
| 2007/0035189 | A1 | 2/2007 | Matsumoto | |
| 2007/0041857 | A1 | 2/2007 | Fleig | |
| 2007/0065280 | A1 | 3/2007 | Fok | |
| 2007/0166160 | A1 | 7/2007 | Russak et al. | |
| 2007/0176502 | A1 | 8/2007 | Kasai et al. | |
| 2007/0224044 | A1 | 9/2007 | Hong et al. | |
| 2007/0269323 | A1 | 11/2007 | Zhou et al. | |
| 2008/0020698 | A1 | 1/2008 | Spaggiari | |
| 2008/0152482 | A1 | 6/2008 | Patel | |
| 2008/0166224 | A1 | 7/2008 | Giffin | |
| 2008/0286130 | A1 | 11/2008 | Purvines | |
| 2008/0314250 | A1 | 12/2008 | Cowie et al. | |
| 2009/0026850 | A1 | 1/2009 | Fu | |
| 2009/0039805 | A1 | 2/2009 | Tang | |
| 2009/0060710 | A1 | 3/2009 | Gammack et al. | |
| 2009/0060711 | A1 | 3/2009 | Gammack et al. | |
| 2009/0097953 | A1 | 4/2009 | Brugger et al. | |
| 2009/0188126 | A1 | 7/2009 | Gaillard et al. | |
| 2009/0191054 | A1 | 7/2009 | Winkler | |
| 2009/0205498 | A1 | 8/2009 | Wang et al. | |
| 2009/0214341 | A1 | 8/2009 | Craig | |
| 2009/0280007 | A1 | 11/2009 | Ou et al. | |
| 2010/0150699 | A1 | 6/2010 | Nicolas et al. | |
| 2010/0162011 | A1 | 6/2010 | Min | |
| 2010/0171465 | A1 | 7/2010 | Seal et al. | |
| 2010/0225012 | A1 | 9/2010 | Fitton et al. | |
| 2010/0226749 | A1 | 9/2010 | Gammack et al. | |
| 2010/0226750 | A1 | 9/2010 | Gammack | |
| 2010/0226751 | A1 | 9/2010 | Gammack et al. | |
| 2010/0226752 | A1 | 9/2010 | Gammack et al. | |
| 2010/0226753 | A1 | 9/2010 | Dyson et al. | |
| 2010/0226754 | A1 | 9/2010 | Hutton et al. | |
| 2010/0226758 | A1 | 9/2010 | Cookson et al. | |
| 2010/0226763 | A1 | 9/2010 | Gammack et al. | |
| 2010/0226764 | A1 | 9/2010 | Gammack et al. | |
| 2010/0226769 | A1 | 9/2010 | Helps | |
| 2010/0226771 | A1 | 9/2010 | Crawford et al. | |
| 2010/0226787 | A1 | 9/2010 | Gammack et al. | |
| 2010/0226797 | A1 | 9/2010 | Fitton et al. | |
| 2010/0226801 | A1 | 9/2010 | Gammack | |
| 2010/0254800 | A1 | 10/2010 | Fitton et al. | |
| 2011/0058935 | A1 | 3/2011 | Gammack et al. | |
| 2011/0072770 | A1 * | 3/2011 | Lakdawala | F24F 3/1603 55/358 |
| 2011/0110805 | A1 | 5/2011 | Gammack et al. | |
| 2011/0164959 | A1 | 7/2011 | Fitton et al. | |
| 2011/0223014 | A1 | 9/2011 | Crawford et al. | |
| 2011/0223015 | A1 | 9/2011 | Gammack et al. | |
| 2011/0236219 | A1 | 9/2011 | Fitton et al. | |
| 2011/0236228 | A1 | 9/2011 | Fitton et al. | |
| 2011/0236229 | A1 | 9/2011 | Fitton et al. | |
| 2012/0031509 | A1 | 2/2012 | Wallace et al. | |
| 2012/0033952 | A1 | 2/2012 | Wallace et al. | |
| 2012/0034108 | A1 | 2/2012 | Wallace et al. | |
| 2012/0039705 | A1 | 2/2012 | Gammack | |
| 2012/0045315 | A1 | 2/2012 | Gammack | |
| 2012/0045316 | A1 | 2/2012 | Gammack | |
| 2012/0057959 | A1 | 3/2012 | Hodgson et al. | |
| 2012/0082561 | A1 | 4/2012 | Gammack et al. | |
| 2012/0093629 | A1 | 4/2012 | Fitton et al. | |
| 2012/0093630 | A1 | 4/2012 | Fitton et al. | |
| 2012/0230658 | A1 | 9/2012 | Fitton et al. | |
| 2014/0212291 | A1 * | 7/2014 | Stagg | F04D 17/06 416/188 |

FOREIGN PATENT DOCUMENTS

| | | |
|---|---|---|
| CA | 2155482 | 9/1996 |
| CH | 346643 | 5/1960 |
| CN | 2085866 | 10/1991 |
| CN | 2111392 | 7/1992 |
| CN | 1437300 | 8/2003 |
| CN | 1510354 | 7/2004 |
| CN | 2650005 | 10/2004 |
| CN | 2713643 | 7/2005 |
| CN | 1680727 | 10/2005 |
| CN | 2833197 | 11/2006 |
| CN | 201180678 | 1/2009 |
| CN | 201221477 | 4/2009 |
| CN | 101424278 | 5/2009 |
| CN | 101424279 | 5/2009 |
| CN | 201281416 | 7/2009 |
| CN | 201349269 | 11/2009 |
| CN | 101749288 | 6/2010 |
| CN | 201502549 | 6/2010 |
| CN | 201568337 | 9/2010 |
| CN | 101936310 | 1/2011 |
| CN | 101984299 | 3/2011 |
| CN | 101985948 | 3/2011 |
| CN | 201763705 | 3/2011 |
| CN | 201763706 | 3/2011 |
| CN | 201770513 | 3/2011 |
| CN | 201779080 | 3/2011 |
| CN | 201802648 | 4/2011 |
| CN | 102095236 | 6/2011 |
| CN | 102367813 | 3/2012 |
| DE | 1 291 090 | 3/1969 |
| DE | 24 51 557 | 5/1976 |
| DE | 27 48 724 | 5/1978 |
| DE | 3644567 | 7/1988 |

(56) References Cited

FOREIGN PATENT DOCUMENTS

| | | |
|---|---|---|
| DE | 195 10 397 | 9/1996 |
| DE | 197 12 228 | 10/1998 |
| DE | 100 00 400 | 3/2001 |
| DE | 10041805 | 6/2002 |
| DE | 10 2009 007 037 | 8/2010 |
| EP | 0 044 494 | 1/1982 |
| EP | 0186581 | 7/1986 |
| EP | 0 556 435 | 8/1993 |
| EP | 1 094 224 | 4/2001 |
| EP | 1 138 954 | 10/2001 |
| EP | 1 779 745 | 5/2007 |
| EP | 1 939 456 | 7/2008 |
| EP | 1 980 432 | 10/2008 |
| EP | 2 000 675 | 12/2008 |
| EP | 2191142 | 6/2010 |
| FR | 1033034 | 7/1953 |
| FR | 1119439 | 6/1956 |
| FR | 1387334 | 1/1965 |
| FR | 2 534 983 | 4/1984 |
| FR | 2 640 857 | 6/1990 |
| FR | 2 658 593 | 8/1991 |
| FR | 2794195 | 12/2000 |
| FR | 2 874 409 | 2/2006 |
| FR | 2 906 980 | 4/2008 |
| GB | 22235 | 6/1914 |
| GB | 383498 | 11/1932 |
| GB | 593828 | 10/1947 |
| GB | 601222 | 4/1948 |
| GB | 633273 | 12/1949 |
| GB | 641622 | 8/1950 |
| GB | 661747 | 11/1951 |
| GB | 863 124 | 3/1961 |
| GB | 1067956 | 5/1967 |
| GB | 1 262 131 | 2/1972 |
| GB | 1 265 341 | 3/1972 |
| GB | 1 278 606 | 6/1972 |
| GB | 1 304 560 | 1/1973 |
| GB | 1 403 188 | 8/1975 |
| GB | 1 434 226 | 5/1976 |
| GB | 1 501 473 | 2/1978 |
| GB | 2 094 400 | 9/1982 |
| GB | 2 107 787 | 5/1983 |
| GB | 2 111 125 | 6/1983 |
| GB | 2 178 256 | 2/1987 |
| GB | 2 185 531 | 7/1987 |
| GB | 2 185 533 | 7/1987 |
| GB | 2 218 196 | 11/1989 |
| GB | 2 236 804 | 4/1991 |
| GB | 2 240 268 | 7/1991 |
| GB | 2 242 935 | 10/1991 |
| GB | 2 285 504 | 7/1995 |
| GB | 2 289 087 | 11/1995 |
| GB | 2383277 | 6/2003 |
| GB | 2 428 569 | 2/2007 |
| GB | 2 452 593 | 3/2009 |
| GB | 2452490 | 3/2009 |
| GB | 2463698 | 3/2010 |
| GB | 2464736 | 4/2010 |
| GB | 2466058 | 6/2010 |
| GB | 2468312 | 9/2010 |
| GB | 2468313 | 9/2010 |
| GB | 2468315 | 9/2010 |
| GB | 2468319 | 9/2010 |
| GB | 2468320 | 9/2010 |
| GB | 2468323 | 9/2010 |
| GB | 2468328 | 9/2010 |
| GB | 2468331 | 9/2010 |
| GB | 2468369 | 9/2010 |
| GB | 2473037 | 3/2011 |
| GB | 2479760 | 10/2011 |
| GB | 2482547 | 2/2012 |
| JP | 31-13055 | 8/1956 |
| JP | 35-4369 | 3/1960 |
| JP | 39-7297 | 3/1964 |
| JP | 49-150403 | 12/1974 |
| JP | 51-7258 | 1/1976 |
| JP | 53-60100 | 5/1978 |
| JP | 56-167897 | 12/1981 |
| JP | 57-71000 | 5/1982 |
| JP | 57-157097 | 9/1982 |
| JP | 61-31830 | 2/1986 |
| JP | 61-116093 | 6/1986 |
| JP | 61-280787 | 12/1986 |
| JP | 62-223494 | 10/1987 |
| JP | 63-179198 | 7/1988 |
| JP | 63-306340 | 12/1988 |
| JP | 64-21300 | 2/1989 |
| JP | 64-83884 | 3/1989 |
| JP | 1-138399 | 5/1989 |
| JP | 1-224598 | 9/1989 |
| JP | 2-146294 | 6/1990 |
| JP | 2-218890 | 8/1990 |
| JP | 2-248690 | 10/1990 |
| JP | 3-52515 | 5/1991 |
| JP | 3-267597 | 11/1991 |
| JP | 3-267598 | 11/1991 |
| JP | 4-43895 | 2/1992 |
| JP | 4-109095 | 4/1992 |
| JP | 4-366330 | 12/1992 |
| JP | 5-157093 | 6/1993 |
| JP | 5-164089 | 6/1993 |
| JP | 5-263786 | 10/1993 |
| JP | 6-74190 | 3/1994 |
| JP | 6-86898 | 3/1994 |
| JP | 6-147188 | 5/1994 |
| JP | 6-257591 | 9/1994 |
| JP | 6-280800 | 10/1994 |
| JP | 6-336113 | 12/1994 |
| JP | 7-190443 | 7/1995 |
| JP | 8-21400 | 1/1996 |
| JP | 8-21648 | 1/1996 |
| JP | 9-100800 | 4/1997 |
| JP | 9-287600 | 11/1997 |
| JP | 11-159499 | 6/1999 |
| JP | 11-227866 | 8/1999 |
| JP | 2000-116179 | 4/2000 |
| JP | 2000-201723 | 7/2000 |
| JP | 2001-17358 | 1/2001 |
| JP | 2002-21797 | 1/2002 |
| JP | 2002-138829 | 5/2002 |
| JP | 2002-213388 | 7/2002 |
| JP | 2003-329273 | 11/2003 |
| JP | 2004-8275 | 1/2004 |
| JP | 2004-16466 | 1/2004 |
| JP | 2004-208935 | 7/2004 |
| JP | 2004-216221 | 8/2004 |
| JP | 2004-232954 | 8/2004 |
| JP | 2005-201507 | 7/2005 |
| JP | 2005-307985 | 11/2005 |
| JP | 2006-89096 | 4/2006 |
| JP | 3127331 | 11/2006 |
| JP | 2007-138763 | 6/2007 |
| JP | 2007-138789 | 6/2007 |
| JP | 2008-39316 | 2/2008 |
| JP | 2008-100204 | 5/2008 |
| JP | 3146538 | 10/2008 |
| JP | 2008-294243 | 12/2008 |
| JP | 2009-44568 | 2/2009 |
| JP | 2009-62987 | 3/2009 |
| JP | 2010-131259 | 6/2010 |
| KR | 10-2005-0102317 | 10/2005 |
| KR | 2007-0007997 | 1/2007 |
| KR | 10-2010-0055611 | 5/2010 |
| KR | 10-0985378 | 9/2010 |
| TW | M394383 | 12/2010 |
| TW | M407299 | 7/2011 |
| WO | WO-90/13478 | 11/1990 |
| WO | WO-02/073096 | 9/2002 |
| WO | WO-03/058795 | 7/2003 |
| WO | WO-03/069931 | 8/2003 |
| WO | WO-2005/050026 | 6/2005 |
| WO | WO-2005/057091 | 6/2005 |
| WO | WO-2006/008021 | 1/2006 |
| WO | WO-2006/012526 | 2/2006 |

(56) References Cited

FOREIGN PATENT DOCUMENTS

| | | |
|---|---|---|
| WO | WO-2006/071503 | 7/2006 |
| WO | WO-2006/083849 | 8/2006 |
| WO | WO-2007/024955 | 3/2007 |
| WO | WO-2007/048205 | 5/2007 |
| WO | WO-2008/014641 | 2/2008 |
| WO | WO-2008/024569 | 2/2008 |
| WO | WO-2009/010528 | 1/2009 |
| WO | WO-2009/030879 | 3/2009 |
| WO | WO-2009/030881 | 3/2009 |
| WO | WO-2010/100451 | 9/2010 |
| WO | WO-2010/100452 | 9/2010 |
| WO | WO-2010/100453 | 9/2010 |
| WO | WO-2010/100462 | 9/2010 |

OTHER PUBLICATIONS

European Search Report dated Dec. 7, 2016, directed to EP Application No. 16 18 4103; 8 pages.
Search Report dated May 20, 2010, directed to GB Application No. 1004812.2; 1 page.
Search Report dated May 20, 2010 directed to GB Application No. 1004813.0; 1 page.
Search Report dated May 20, 2010, directed to GB Application No. 1004814.8; 1 page.
Search Report dated Jan. 20, 2009 directed GB Application No. 0819612.3; 1 page.
International Search Report and Written Opinion dated Jun. 1, 2011, directed to International Application No. PCT/GB2011/050427; 11 pages.
International Search Report and Written Opinion dated Jul. 13, 2011, directed to International Application No. PCT/GB2011/050429; 11 pages.
International Search Report and Written Opinion dated Jul. 15, 2011, directed to International Application No. PCT/GB2011/050428; 13 pages.
International Search Report and Written Opinion dated Dec. 17, 2009, directed to International Application No. PCT/GB2009/051401; 14 pages.
Fitton et al., U.S. Office Action dated Oct. 26, 2012, directed to U.S. Appl. No. 13/052,832; 13 pages.
Fitton et al., U.S. Office Action dated May 14, 2013, directed to U.S. Appl. No. 13/052,832; 15 pages.
Fitton et al., U.S. Office Action dated Sep. 13, 2013, directed to U.S. Appl. No. 13/052,832; 13 pages.
Fitton et al., U.S. Office Action dated Nov. 15, 2012, directed to U.S. Appl. No. 13/052,830; 10 pages.
Fitton et al., U.S. Office Action dated May 15, 2013, directed to U.S. Appl. No. 13/052,830; 11 pages.
Fitton et al., U.S. Office Action dated Sep. 13, 2013, directed to U.S. Appl. No. 13/052,830; 10 pages.
Fitton et al., U.S. Office Action dated Nov. 6, 2013, directed to U.S. Appl. No. 13/052,846; 29 pages.
Simmonds et al., U.S. Office Action dated Dec. 27, 2013, directed to U.S. Appl. No. 13/125,742; 18 pages.
Simmonds et al., U.S. Office Action dated Sep. 16, 2014, directed to U.S. Appl. No. 13/125,742; 18 pages.
Simmonds et al., U.S. Office Action dated Mar. 26, 2015, directed to U.S. Appl. No. 13/125,742; 16 pages.
Simmonds et al., U.S. Office Action dated Sep. 11, 2015, directed to U.S. Appl. No. 13/125,742; 13 pages.
Simmonds et al., U.S. Office Action dated Apr. 14, 2016, directed to U.S. Appl. No. 13/125,742; 18 pages.
Simmonds et al., U.S. Office Action dated Oct. 25, 2016, directed to U.S. Appl. No. 13/125,742; 11 pages.
Simmonds et al., Ex Parte Quayle Action mailed Jun. 27, 2017, directed to U.S. Appl. No. 13/125,742; 4 pages.
Gammack et al., U.S. Office Action dated Dec. 9, 2010, directed to U.S. Appl. No. 12/203,698; 10 pages.
Gammack et al., U.S. Office Action dated Jun. 21, 2011, directed to U.S. Appl. No. 12/203,698; 11 pages.
Gammack et al., U.S. Office Action dated Sep. 17, 2012, directed to U.S. Appl. No. 13/114,707; 12 pages.
Gammack et al., U.S. Office Action dated Dec. 10, 2010, directed to U.S. Appl. No. 12/230,613; 12 pages.
Gammack et al., U.S. Office Action dated May 13, 2011, directed to U.S. Appl. No. 12/230,613; 13 pages.
Gammack et al., U.S. Office Action dated Sep. 7, 2011, directed to U.S. Appl. No. 12/230,613; 15 pages.
Gammack et al., U.S. Office Action dated Jun. 8, 2012, directed to U.S. Appl. No. 12/230,613; 15 pages.
Gammack et al., U.S. Office Action dated Aug. 20, 2012, directed to U.S. Appl. No. 12/945,558; 15 pages.
Fitton et al., U.S. Office Action dated Nov. 30, 2010 directed to U.S. Appl. No. 12/560,232; 9 pages.
Nicolas et al., U.S. Office Action dated Mar. 7, 2011, directed to U.S. Appl. No. 12/622,844; 10 pages.
Nicolas et al., U.S. Office Action dated Sep. 8, 2011, directed to U.S. Appl. No. 12/622,844; 11 pages.
Fitton et al., U.S. Office Action dated Mar. 8, 2011, directed to U.S. Appl. No. 12/716,780; 12 pages.
Fitton et al., U.S. Office Action dated Sep. 6, 2011, directed to U.S. Appl. No. 12/716,780; 16 pages.
Gammack et al., U.S. Office Action dated Dec. 9, 2010, directed to U.S. Appl. No. 12/716,781; 17 pages.
Gammack et al., U.S. Office Action dated Jun. 24, 2011, directed to U.S. Appl. No. 12/716,781; 19 pages.
Gammack et al., U.S. Office Action dated Apr. 12, 2011, directed to U.S. Appl. No. 12/716,749; 8 pages.
Gammack et al., U.S. Office Action dated Sep. 1, 2011, directed to U.S. Appl. No. 12/716,749; 9 pages.
Gammack et al., U.S. Office Action dated Jun. 25, 2012, directed to U.S. Appl. No. 12/716,749; 11 pages.
Fitton et al., U.S. Office Action dated Mar. 30, 2012, directed to U.S. Appl. No. 12/716,707; 7 pages.
Gammack et al., U.S. Office Action dated May 24, 2011, directed to U.S. Appl. No. 12/716,613; 9 pages.
Reba, I. (1966). "Applications of the Coanda Effect," *Scientific American* 214:84-92.
Third Party Submission Under 37 CFR 1.99 filed Jun. 2, 2011, directed to U.S. Appl. No. 12/203,698; 3 pages.
Gammack et al., U.S. Office Action dated Jun. 15, 2009, directed to U.S. Appl. No. 29/328,939; 5 pages.

* cited by examiner

FAN WITH A FILTER

REFERENCE TO RELATED APPLICATIONS

This application is a continuation of U.S. patent application Ser. No. 13/125,742, filed Jul. 8, 2011, which is a national stage application under 35 USC 371 of International Application No. PCT/GB2009/051401, filed Oct. 19, 2009, which claims the priority of United Kingdom Application No. 0819612.3, filed Oct. 25, 2008, the entire contents of which are incorporated herein by reference.

FIELD OF THE INVENTION

The present invention relates to a fan appliance. Particularly, but not exclusively, the present invention relates to a domestic fan, such as a desk fan, for creating air circulation and air current in a room, in an office or other domestic environment.

BACKGROUND OF THE INVENTION

A number of types of domestic fan are known. It is common for a conventional fan to include a single set of blades or vanes mounted for rotation about an axis, and driving apparatus mounted about the axis for rotating the set of blades. Domestic fans are available in a variety of sizes and diameters, for example, a ceiling fan can be at least 1 m in diameter and is usually mounted in a suspended manner from the ceiling and positioned to provide a downward flow of air and cooling throughout a room.

Desk fans, on the other hand, are often around 30 cm in diameter and are usually free standing and portable. In standard desk fan arrangements the single set of blades is positioned close to the user and the rotation of the fan blades provides a forward flow of air current in a room or into a part of a room, and towards the user. Other types of fan can be attached to the floor or mounted on a wall. The movement and circulation of the air creates a so called 'wind chill' or breeze and, as a result, the user experiences a cooling effect as heat is dissipated through convection and evaporation. Fans such as that disclosed in USD 103,476 are suitable for standing on a desk or a table. U.S. Pat. No. 2,620,127 discloses a dual purpose fan suitable for use either mounted in a window or as a portable desk fan.

In a domestic environment it is desirable for appliances to be as small and compact as possible. U.S. Pat. No. 1,767,060 describes a desk fan with an oscillating function that aims to provide an air circulation equivalent to two or more prior art fans. In a domestic environment it is undesirable for parts to project from the appliance, or for the user to be able to touch any moving parts of the fan, such as the blades. USD 103,476 includes a cage around the blades. Other types of fan or circulator are described in U.S. Pat. Nos. 2,488,467, 2,433,795 and JP 56-167897. The fan of U.S. Pat. No. 2,433,795 has spiral slots in a rotating shroud instead of fan blades.

Some of the above prior art arrangements have safety features such as a cage or shroud around the blades to protect a user from injuring himself on the moving parts of the fan. However, caged blade parts can be difficult to clean and the movement of blades through air can be noisy and disturbing in a home or office environment.

A disadvantage of certain of the prior art arrangements is that the air flow produced by the fan is not felt uniformly by the user due to variations across the blade surface or across the outward facing surface of the fan. Uneven or 'choppy' air flow can be felt as a series of pulses or blasts of air. The uneven air flow may move and disturb dust and debris located in the vicinity of the fan, causing it to be projected towards the user. Furthermore, this type of air flow can cause lightweight items, such as papers or stationery, placed close to the fan to move or become dislodged from their location. This is disruptive in a home or office environment.

A further disadvantage is that the cooling effect created by the fan diminishes with distance from the user. This means the fan must be placed in close proximity to the user in order for the user to receive the benefit of the fan. Locating fans such as those described above close to a user is not always possible as the bulky shape and structure mean that the fan occupies a significant amount of the user's work space area. In the particular case of a fan placed on, or close to, a desk the fan body reduces the area available for paperwork, a computer or other office equipment.

The shape and structure of a fan at a desk not only reduces the working area available to a user but can block natural light (or light from artificial sources) from reaching the desk area. A well lit desk area is desirable for close work and for reading. In addition, a well lit area can reduce eye strain and the related health problems that may result from prolonged periods working in reduced light levels.

The present invention seeks to provide an improved fan assembly which obviates disadvantages of the prior art. It is an object of the present invention to provide a fan assembly which, in use, generates air flow at an even rate over the emission output area of the fan. It is another object to provide an improved fan assembly whereby a user at a distance from the fan feels an improved air flow, improved air quality and improved cooling effect in comparison to prior art fans.

SUMMARY OF THE INVENTION

According to the invention, there is provided a fan assembly for creating an air current, the fan assembly comprising a nozzle, means for creating an air flow through the nozzle and a filter for removing particulates from the air flow, the nozzle comprising an interior passage, a mouth for receiving the air flow from the interior passage, and a Coanda surface located adjacent the mouth and over which the mouth is arranged to direct the air flow.

Advantageously, by this arrangement a filtered air flow is generated and can be projected from the fan and delivered to the user.

The filter may comprise one or any number of filters or filters assemblies in one or more locations within the fan assembly. The filter material may comprise filter media such as foam materials, carbon, paper, HEPA (High Efficiency Particle Arrester) filter media, fabric or open cell polyurethane foam, for example. The filter may comprise a mesh or porous material located around a base of the fan assembly, and may form part of, or be mounted to, the outer casing. The filter may be suitable for removal of specific pollutants and particulates from the air flow and may be used for chemical or odor removal. Other filtration schemes or processing systems such as ionization or UV treatment could be used in any combination within the filter and within the fan assembly.

The filter may be located upstream of the means for creating an airflow. The benefit of this arrangement is that the means for creating an air flow is reliably protected from debris and dust that may be drawn into the appliance and which may damage the fan assembly. The filter may be located between an air inlet of the fan assembly and the means for creating an air flow. Alternatively, the filter may be located upstream of the air inlet. For example, the filter may surround or otherwise extend about a part of the fan assembly in which the air inlet is located. This part may be a base of the fan assembly to which the nozzle is connected.

Alternatively, or additionally, a filter may be located downstream of the means for creating an airflow through the nozzle. Advantageously, in this position it is possible to filter and clean the air drawn through the means for creating an air flow, including any exhaust emissions from said means, prior to progression through the elements of the fan assembly and supply to the user.

The filter may be located within the nozzle. This arrangement provides filtration in the air flow path through the nozzle resulting in a reduction in wear on the parts of the fan assembly and thus a reduction in the maintenance costs. Preferably, an additional filter is located upstream of the means for creating an air flow. Advantageously, this arrangement provides a superior level of filtration and cleaning of the air flow in the appliance. As well as filtration of the air flow path through the nozzle, the additional filter ensures that the said means is protected from debris and dust that may be drawn into the appliance.

Preferably the fan assembly is bladeless. By this arrangement an air current is generated and a cooling effect is created without requiring a bladed fan. The bladeless arrangement leads to lower noise emissions due to the absence of the sound of a fan blade moving through the air, and a reduction in moving parts and complexity.

In the following description of fans and, in particular a fan of the preferred embodiment, the term 'bladeless' is used to describe apparatus in which air flow is emitted or projected forwards from the fan assembly without the use of blades. By this definition a bladeless fan assembly can be considered to have an output area or emission zone absent blades or vanes from which the air flow is released or emitted in a direction appropriate for the user. A bladeless fan assembly may be supplied with a primary source of air from a variety of sources or generating means such as pumps, generators, motors or other fluid transfer devices, which include rotating devices such as a motor rotor and a bladed impeller for generating air flow. The supply of air generated by the motor causes a flow of air to pass from the room space or environment outside the fan assembly through the interior passage to the nozzle and then out through the mouth.

Hence, the description of a fan assembly as bladeless is not intended to extend to the description of the power source and components such as motors that are required for secondary fan functions. Examples of secondary fan functions can include lighting, adjustment and oscillation of the fan.

The fan assembly achieves the output and cooling effect described above with a nozzle which includes a Coanda surface to provide an amplifying region utilizing the Coanda effect. A Coanda surface is a known type of surface over which fluid flow exiting an output orifice close to the surface exhibits the Coanda effect. The fluid tends to flow over the surface closely, almost 'clinging to' or 'hugging' the surface. The Coanda effect is already a proven, well documented method of entrainment whereby a primary air flow is directed over the Coanda surface. A description of the features of a Coanda surface, and the effect of fluid flow over a Coanda surface, can be found in articles such as Reba, Scientific American, Volume 214, June 1963 pages 84 to 92.

Preferably the nozzle extends about an axis to define an opening through which air from outside the fan assembly is drawn by the air flow directed over the Coanda surface. Air from the external environment is drawn through the opening by the air flow directed over the Coanda surface. Advantageously, by this arrangement the assembly can be produced and manufactured with a reduced number of parts than those required in prior art fans. This reduces manufacturing cost and complexity.

In the present invention an air flow is created through the nozzle of the fan assembly. In the following description this air flow will be referred to as primary air flow. The primary air flow exits the nozzle via the mouth and passes over the Coanda surface. The primary air flow entrains the air surrounding the mouth of the nozzle, which acts as an air amplifier to supply both the primary air flow and the entrained air to the user. The entrained air will be referred to here as a secondary air flow. The secondary air flow is drawn from the room space, region or external environment surrounding the mouth of the nozzle and, by displacement, from other regions around the fan assembly. The primary air flow directed over the Coanda surface combined with the secondary air flow entrained by the air amplifier gives a total air flow emitted or projected forward to a user from the opening defined by the nozzle. The total air flow is sufficient for the fan assembly to create an air current suitable for cooling.

The air current delivered by the fan assembly to the user has the benefit of being an air flow with low turbulence and with a more linear air flow profile than that provided by other prior art devices. Advantageously, the air flow from the fan can be projected forward from the opening and the area surrounding the mouth of the nozzle with a laminar flow that is experienced by the user as a superior cooling effect to that from a bladed fan. The linear or laminar air flow with low turbulence travels efficiently out from the point of emission and loses less energy and less velocity to turbulence than the air flow generated by prior art fans. An advantage for a user is that the cooling effect can be felt even at a distance and the overall efficiency of the fan increases. This means that the user can choose to site the fan some distance from a work area or desk and still be able to feel the cooling benefit of the fan.

Advantageously, the assembly results in the entrainment of air surrounding the mouth of the nozzle such that the primary air flow is amplified by at least 15%, while a smooth overall output is maintained. The entrainment and amplification features of the fan assembly result in a fan with a higher efficiency than prior art devices. The air current emitted from the opening defined by the nozzle has an approximately flat velocity profile across the diameter of the nozzle. Overall the flow rate and profile can be described as plug flow with some regions having a laminar or partial laminar flow.

Preferably, the Coanda surface extends symmetrically about the axis. More preferably, the angle subtended between the Coanda surface and the axis is in the range from 7° to 20°, preferably around 15°. This provides an efficient primary air flow over the Coanda surface and leads to maximum air entrainment and secondary air flow.

Preferably the nozzle extends by a distance of at least 5 cm in the direction of the axis, more preferably the nozzle extends about the axis by a distance in the range from 30 cm to 180 cm. This provides options for emission of air over a range of different output areas and opening sizes, such as may be suitable for cooling the upper body and face of a user when working at a desk, for example.

Preferably the nozzle comprises a loop. The shape of the nozzle is not constrained by the requirement to include space for a bladed fan. In a preferred embodiment the nozzle is substantially annular. By providing an annular nozzle the fan can potentially reach a broad area. In addition, an illumination source in the room or at the desk fan location or natural light can reach the user through the central opening. In a further preferred embodiment the nozzle is at least partially circular. This arrangement can provide a variety of design options for the fan, increasing the choice available to a user or customer.

In the preferred embodiment the nozzle comprises a diffuser located downstream of the Coanda surface. An angular arrangement of the diffuser surface and an aerofoil-type shaping of the nozzle and diffuser surface can enhance the amplification properties of the fan assembly while minimizing noise and frictional losses.

In a preferred arrangement the nozzle comprises at least one wall defining the interior passage and the mouth, and the at least one wall comprises opposing surfaces defining the mouth. Preferably, the mouth has an outlet, and the spacing between the opposing surfaces at the outlet of the mouth is in the range from 1 mm to 10 mm, more preferably around 5 mm By this arrangement a nozzle can be provided with the desired flow properties to guide the primary air flow over the Coanda surface and provide a relatively uniform, or close to uniform, total air flow reaching the user.

In the preferred fan arrangement the means for creating an air flow through the nozzle comprises an impeller driven by a motor. This arrangement provides a fan with efficient air flow generation. More preferably the means for creating an air flow comprises a DC brushless motor and a mixed flow impeller. This arrangement provides an efficient motor package. In addition the arrangement reduces frictional losses from motor brushes and also reduces carbon debris from the brushes in a traditional motor. Reducing carbon debris and emissions is advantageous in a clean or pollutant sensitive environment such as a hospital or around those with allergies. The means for creating an air flow through the nozzle is preferably located in a base of the fan assembly, the nozzle being connected to the base to receive the air flow.

The nozzle may be rotatable or pivotable relative to a base portion, or other portion, of the fan assembly. This enables the nozzle to be directed towards or away from a user as required. The fan assembly may be desk, floor, wall or ceiling mountable. This can increase the portion of a room over which the user experiences cooling.

BRIEF DESCRIPTION OF THE DRAWINGS

Embodiments of the invention will now be described with reference to the accompanying drawings, in which.

DETAILED DESCRIPTION OF THE INVENTION

Figure 1:
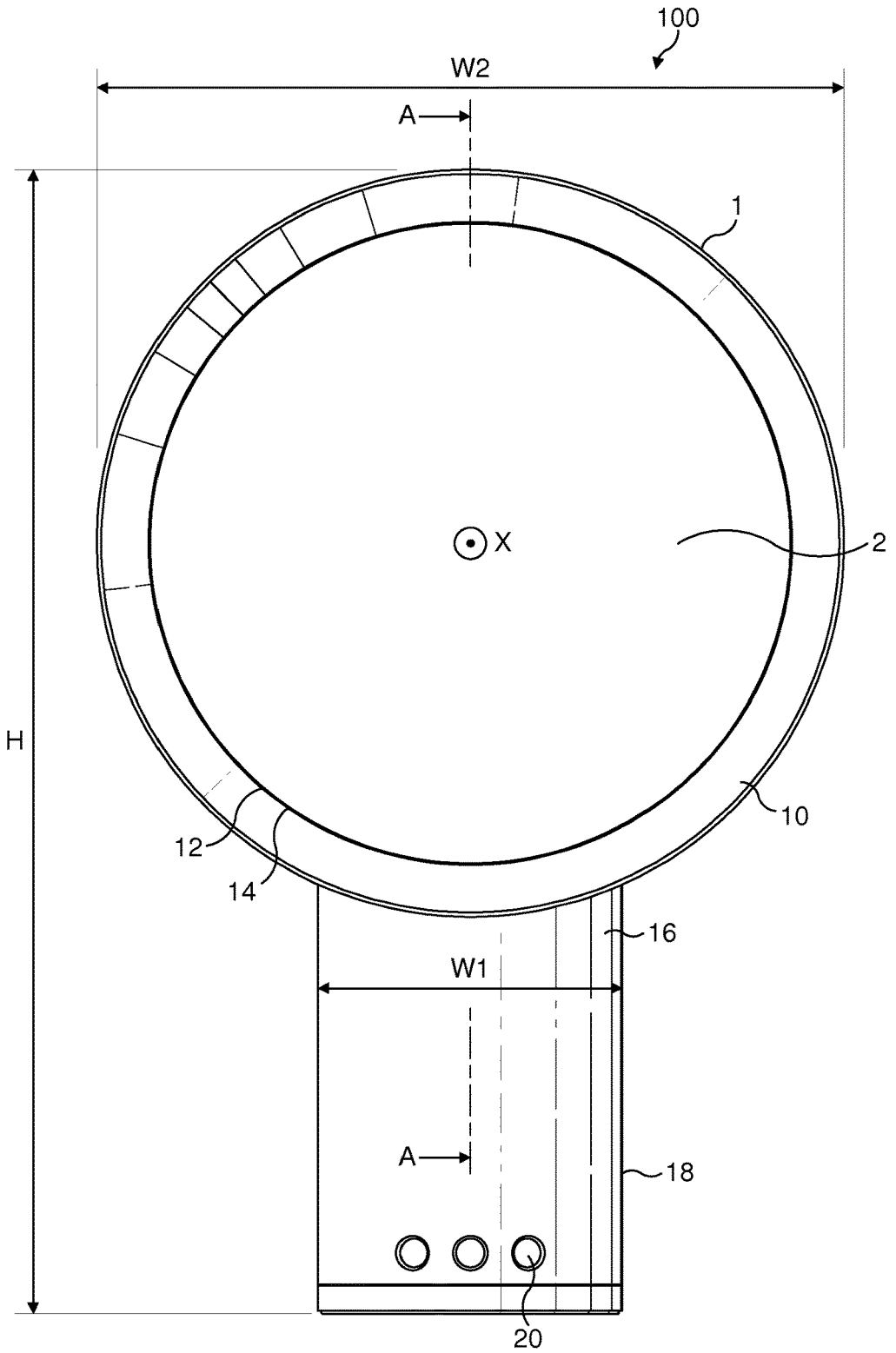
FIG. 1 is a front view of a fan assembly.
Figure 2:
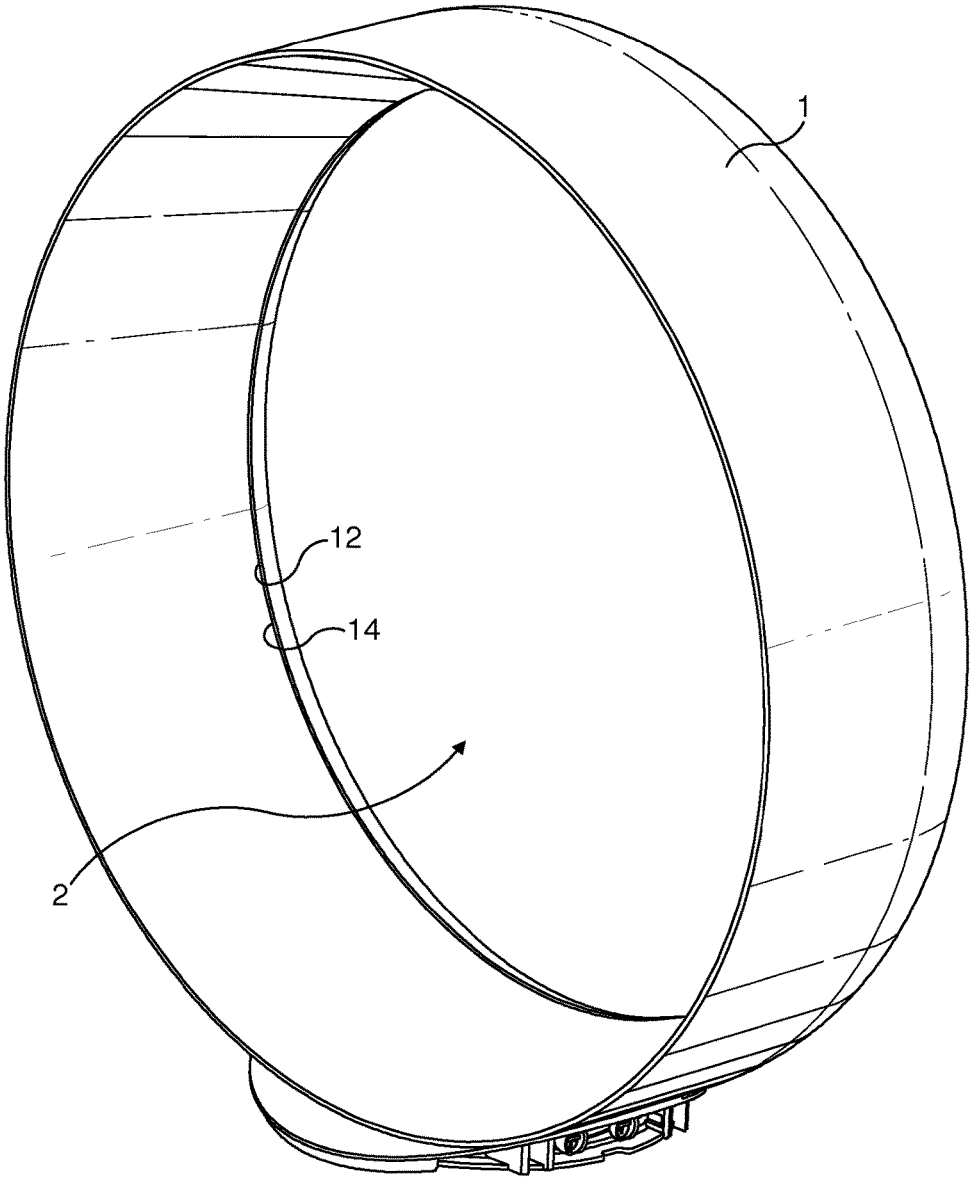
FIG. 2 is a perspective view of a portion of the fan assembly of FIG. 1.
Figure 3:
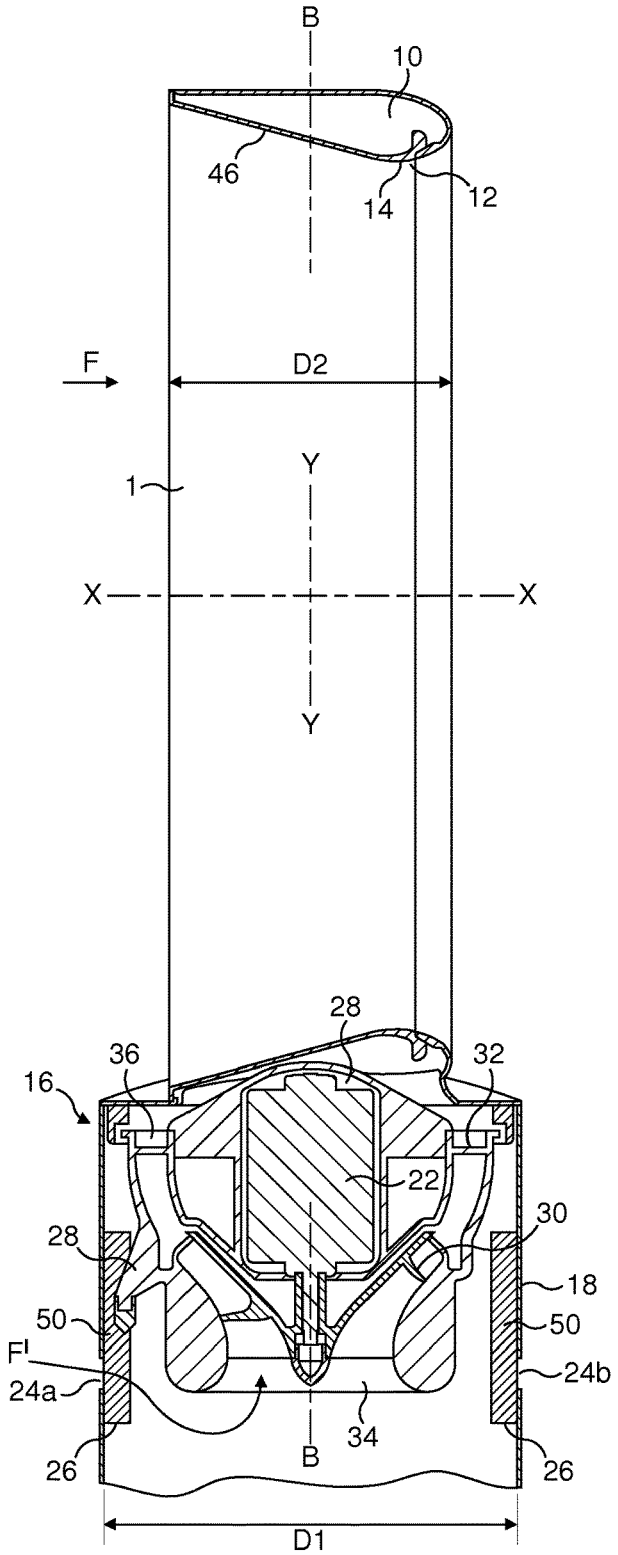
FIG. 3 is a side sectional view taken at line A-A through a portion of the fan assembly of FIG. 1, illustrating a first filter arrangement

FIG. 1 shows an example of a fan assembly 100 viewed from the front of the device. The fan assembly 100 comprises an annular nozzle 1 defining a central opening 2. With reference also to FIGS. 2 and 3, nozzle 1 comprises an interior passage 10, a mouth 12 and a Coanda surface 14 adjacent the mouth 12. The Coanda surface 14 is arranged so that a primary air flow exiting the mouth 12 and directed over the Coanda surface 14 is amplified by the Coanda effect. The nozzle 1 is connected to, and supported by, a base 16 having an outer casing 18. The base 16 includes a plurality of selection buttons 20 accessible through the outer casing 18 and through which the fan assembly 100 can be operated.

Figure 4:
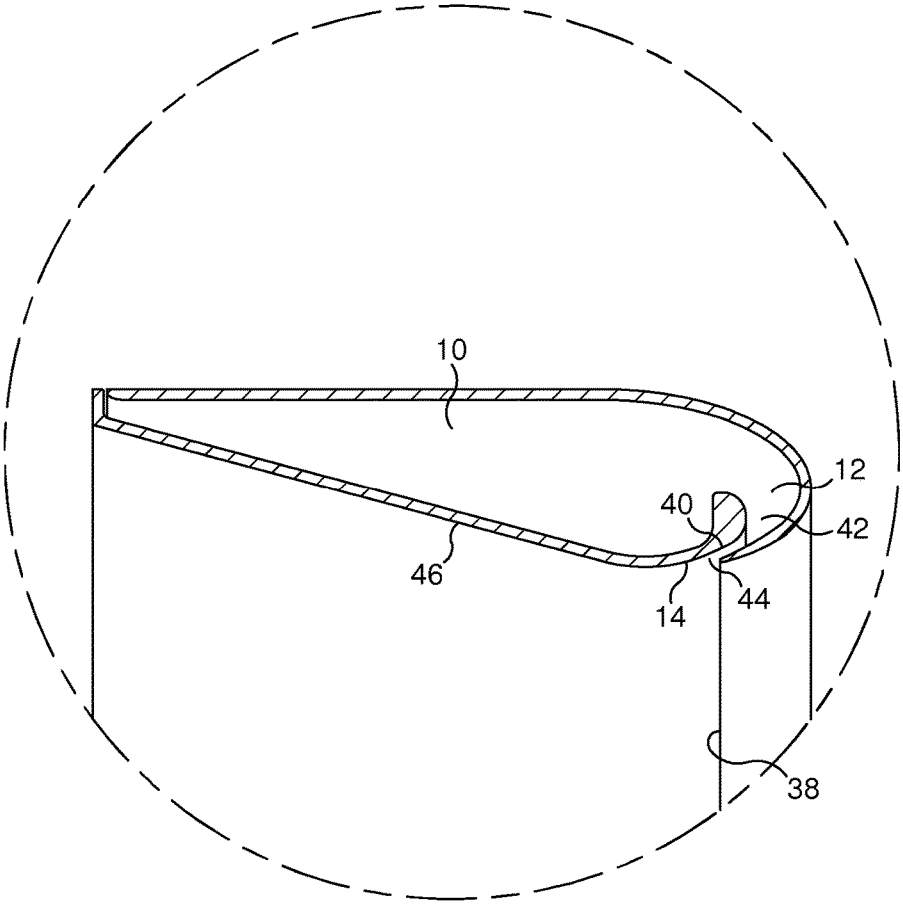
FIG. 4 is an enlarged side sectional detail of a portion of the fan assembly of FIG. 1.
Figure 5:
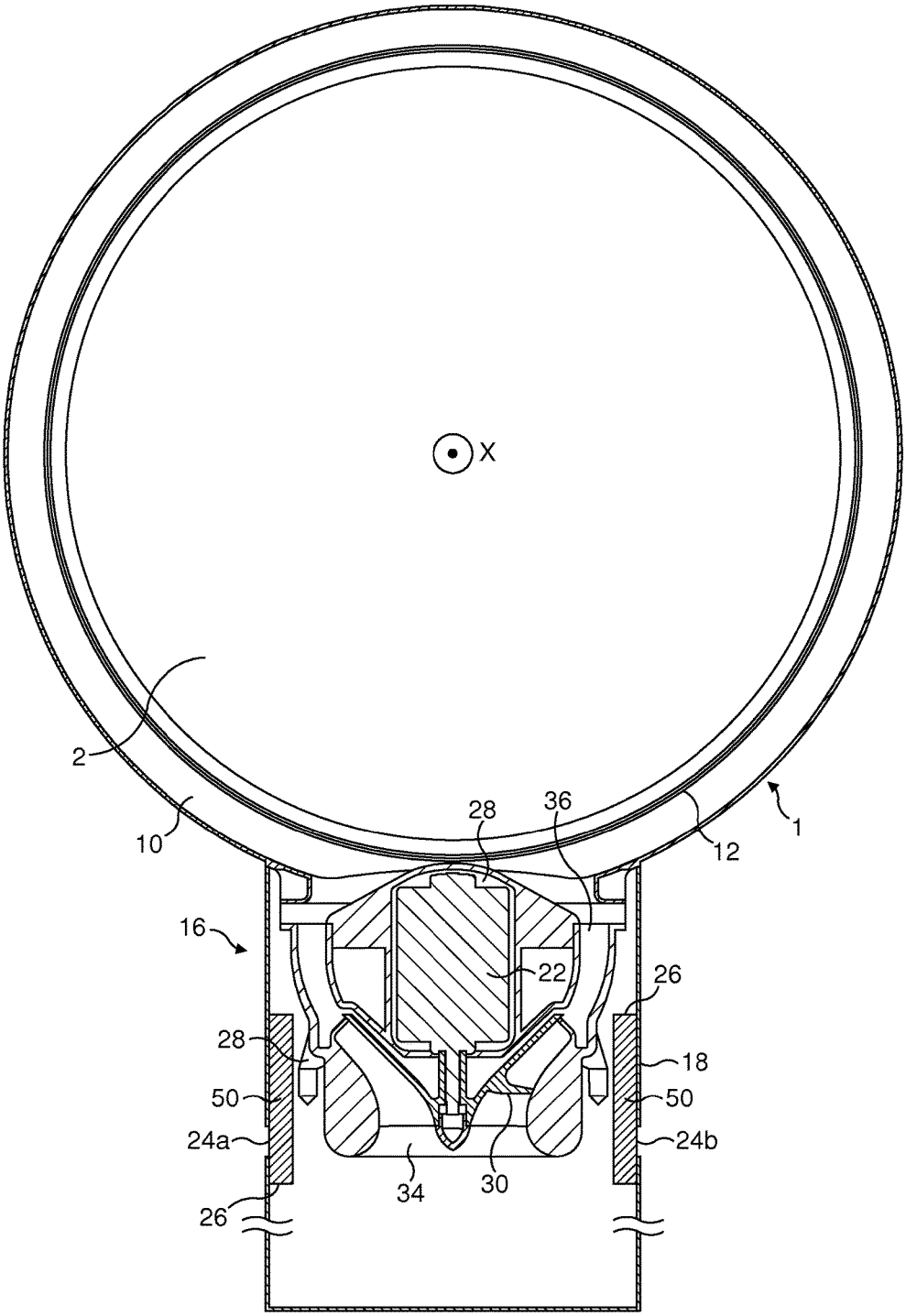
FIG. 5 is a sectional view of the fan assembly taken along line B-B of FIG. 3 and viewed from direction F of FIG. 3.

FIGS. 3, 4 and 5 show further specific details of the fan assembly 100. A motor 22 for creating an air flow through the nozzle 1 is located inside the base 16. The base 16 further comprises an air inlet 24*a*, 24*b* formed in the outer casing 18 and through which air is drawn into the base 16. A motor housing 28 for the motor 22 is also located inside the base 16. The motor 22 is supported by the motor housing 28 and held or fixed in a secure position within the base 16.

In the illustrated embodiment, the motor 22 is a DC brushless motor. An impeller 30 is connected to a rotary shaft extending outwardly from the motor 22, and a diffuser 32 is positioned downstream of the impeller 30. The diffuser 32 comprises a fixed, stationary disc having spiral blades.

An inlet 34 to the impeller 30 communicates with the air inlet 24*a*, 24*b* formed in the outer casing 18 of the base 16. The outlet 36 of the diffuser 32 and the exhaust from the impeller 30 communicate with hollow passageway portions or ducts located inside the base 16 in order to establish air flow from the impeller 30 to the interior passage 10 of the nozzle 1. The motor 22 is connected to an electrical connection and power supply and is controlled by a controller (not shown). Communication between the controller and the plurality of selection buttons 20 enable a user to operate the fan assembly 100.

The features of the nozzle 1 will now be described with reference to FIGS. 3 and 4. The shape of the nozzle 1 is annular. In this embodiment the nozzle 1 has a diameter of around 350 mm, but the nozzle 1 may have any desired diameter, for example around 300 mm. The interior passage 10 is annular and is formed as a continuous loop or duct within the nozzle 1. The nozzle 1 is formed from at least one wall defining the interior passage 10 and the mouth 12. In this embodiment the nozzle 1 comprises an inner wall 38 and an outer wall 40. In the illustrated embodiment the walls 38, 40 are arranged in a looped or folded shape such that the inner wall 38 and outer wall 40 approach one another. The inner wall 38 and the outer wall 40 together define the mouth 12, and the mouth 12 extends about the axis X. The mouth 12 comprises a tapered region 42 narrowing to an outlet 44. The outlet 44 comprises a gap or spacing formed between the inner wall 38 of the nozzle 1 and the outer wall 40 of the nozzle 1. The spacing between the opposing surfaces of the walls 38, 40 at the outlet 44 of the mouth 12 is chosen to be in the range from 1 mm to 10 mm. The choice of spacing will depend on the desired performance characteristics of the fan. In this embodiment the outlet 44 is around 5 mm wide, and the mouth 12 and the outlet 44 are concentric with the interior passage 10.

The mouth 12 is adjacent the Coanda surface 14. The nozzle 1 further comprises a diffuser portion located downstream of the Coanda surface. The diffuser portion includes a diffuser surface 46 to further assist the flow of air current delivered or output from the fan assembly 100. In the example illustrated in FIG. 3 the mouth 12 and the overall arrangement of the nozzle 1 is such that the angle subtended between the Coanda surface 14 and the axis X is around 15°. The angle is chosen for efficient air flow over the Coanda surface 14. The base 16 and the nozzle 1 have a depth in the direction of the axis X. The nozzle 1 extends by a distance of around 5 cm in the direction of the axis. The diffuser surface 46 and the overall profile of the nozzle 1 are based on an aerofoil shape, and in the example shown the diffuser portion extends by a distance of around two thirds the overall depth of the nozzle 1.

The fan assembly 100 described above operates in the following manner When a user makes a suitable selection from the plurality of buttons 20 to operate or activate the fan assembly 100, a signal or other communication is sent to drive the motor 22. The motor 22 is thus activated and air is drawn into the fan assembly 100 via the air inlet. In the preferred embodiment air is drawn in at a rate of approximately 40 to 100 liters per second, preferably around 80 l/s (liters per second). The air passes through the outer casing 18 and along the route illustrated by arrows F, F" of FIGS. 3 and 6 to the inlet 34 of the impeller 30. The air flow leaving the outlet 36 of the diffuser 32 and the exhaust of the impeller 30 is divided into two air flows that proceed in opposite directions through the interior passage 10. The air flow is constricted as it enters the mouth 12 and is further constricted at the outlet 44 of the mouth 12. The constriction creates pressure in the system. The motor 22 creates an air flow through the nozzle 1 having a pressure of at least 300 kPa and a pressure of up to 700 kPa may be used. The air flow created overcomes the pressure created by the constriction and the air flow exits through the outlet 44 as a primary air flow.

The output and emission of the primary air flow creates a low pressure area at the air inlet with the effect of drawing additional air into the fan assembly 100. The operation of the fan assembly 100 induces high air flow through the nozzle 1 and out through the opening 2. The primary air flow is directed over the Coanda surface 14 and the diffuser surface 46, and is amplified by the Coanda effect. A secondary air flow is generated by entrainment of air from the external environment, specifically from the region around the outlet 44 and from around the outer edge of the nozzle 1. A portion of the secondary air flow entrained by the primary air flow may also be guided over the diffuser surface 46. This secondary air flow passes through the opening 2, where it combines with the primary air flow to produce a total air flow projected forward from the nozzle 1.

The combination of entrainment and amplification results in a total air flow from the opening 2 of the fan assembly 100 that is greater than the air flow output from a fan assembly without such a Coanda or amplification surface adjacent the emission area.

The amplification and laminar type of air flow produced results in a sustained flow of air being directed towards a user from the nozzle 1. In the preferred embodiment the mass flow rate of air projected from the fan assembly 100 is at least 450 l/s, preferably in the range from 600 l/s to 700 l/s. The flow rate at a distance of up to 3 nozzle diameters (i.e. around 1000 to 1200 mm) from a user is around 400 to 500 l/s. The total air flow has a velocity of around 3 to 4 m/s (meters per second). Higher velocities are achievable by reducing the angle subtended between the Coanda surface 14 and the axis X. A smaller angle results in the total air flow being emitted in a more focussed and directed manner This type of air flow tends to be emitted at a higher velocity but with a reduced mass flow rate. Conversely, greater mass flow can be achieved by increasing the angle between the Coanda surface and the axis. In this case the velocity of the emitted air flow is reduced but the mass flow generated increases. Thus the performance of the fan assembly can be altered by altering the angle subtended between the Coanda surface and the axis X. Performance of the fan assembly A first filter arrangement for the fan assembly 100 is illustrated in FIGS. 3 and 5. The first filter arrangement comprises a filter 26, which comprises a filter medium 50. In this filter arrangement the filter 26 is placed upstream of the motor 22 and impeller 30 of the fan assembly 100, and downstream of the air inlet 24*a*, 24*b*. Consequently air flow drawn into the base 16 through the air inlet 24*a* passes through the filter 26 and the filter medium 50 before entering the motor housing 28. The air flow is constricted as it enters the filter 26 and passes through the filter medium 50. The filter 26 provides a pre-motor filter in the fan assembly 100, and the motor is thereby reliably protected from dirt, dust and debris that may be drawn into the device.

In the illustrated arrangement, the filter 26 is positioned adjacent the air inlet 24*a*, 24*b*. The filter 26 is located such that it extends cylindrically about an axis Y, perpendicular to the axis X. The fan assembly 100 will include a recess or other shaping into which the filter 26 is received. The recess is preferably designed to accommodate snugly the filter 26. In addition, the filter 26 is preferably mounted and secured within the recess to establish an air-tight seal so that all of the air flow drawn into the air inlet 24*a*, 24*b* will pass through the filter medium 50. The filter 26 is preferably fixedly connected and secured within the fan assembly 100 by suitable fixings such as screw-threaded portions, fasteners, seal members or other equivalent means.

Figure 6:
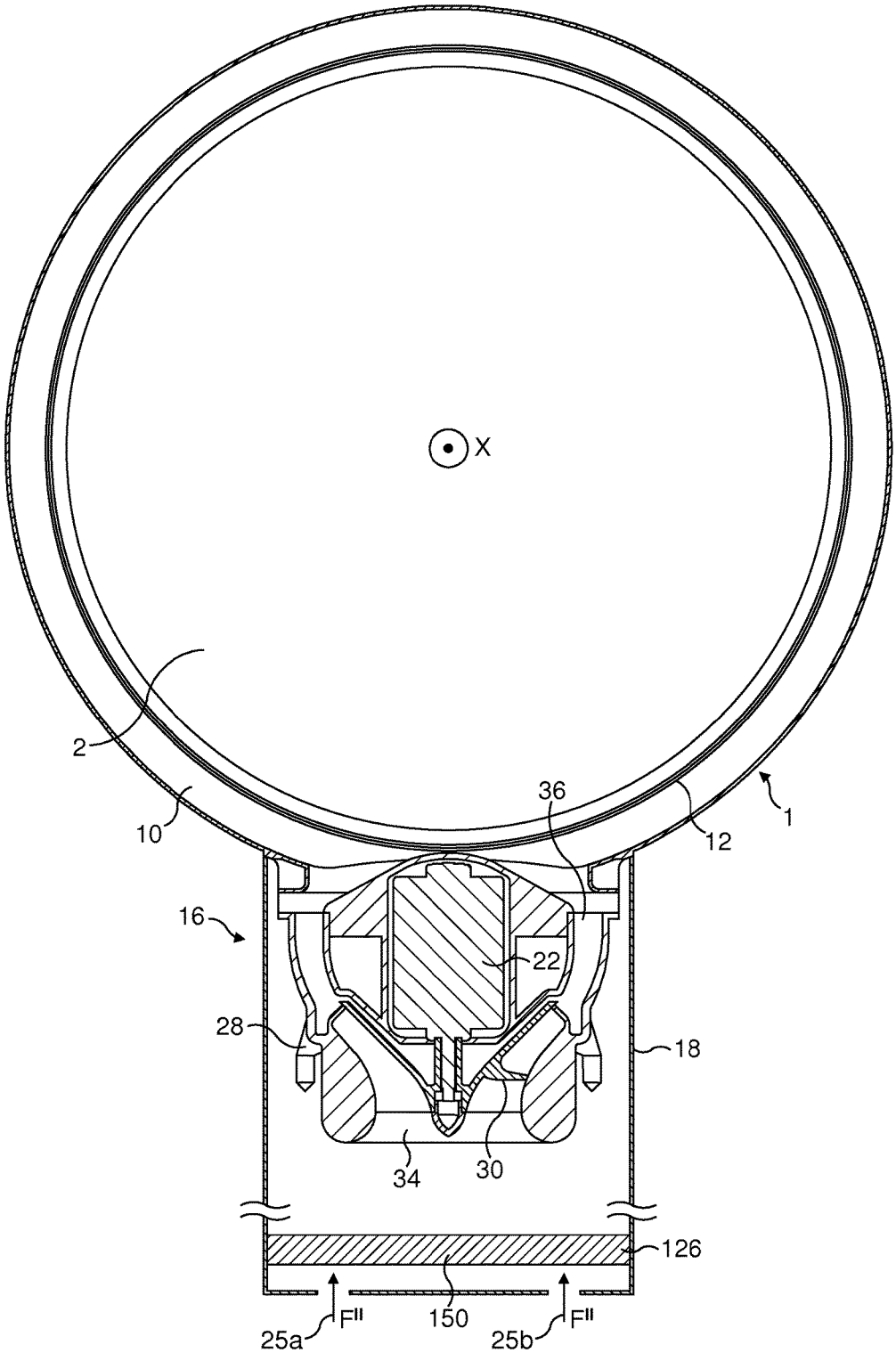
FIG. 6 is a sectional view of the fan assembly of FIG. 1, illustrating a second filter arrangement.

A second filter arrangement for the fan assembly 100 is illustrated in FIG. 6. The second filter arrangement comprises a filter 126, which comprises a filter medium 150. The fan assembly 100 illustrated in FIG. 6 differs from that illustrated in FIGS. 3 and 5 in that air inlets 25*a*, 25*b* are formed in the lower surface of the outer casing 18, rather than in the cylindrical side wall thereof. The filter 126 is positioned adjacent the lower air inlets 25*a*, 25*b* and shaped so as to substantially cover the lower surface of the base 16. The filter 126 is preferably mounted and secured in a fixed arrangement within the base 16 to establish an air-tight seal so that all of the air flow drawn into air inlet 25*a*, 25*b* will pass through the filter medium 150. The filter 126 is preferably fixedly connected and secured within the fan assembly 100 by suitable fixings. As described previously, the filter 126 thus provides a pre-motor filter in the fan assembly 100, and the motor is thereby reliably protected from dirt, dust and debris that may be drawn into the device.

Figure 7:
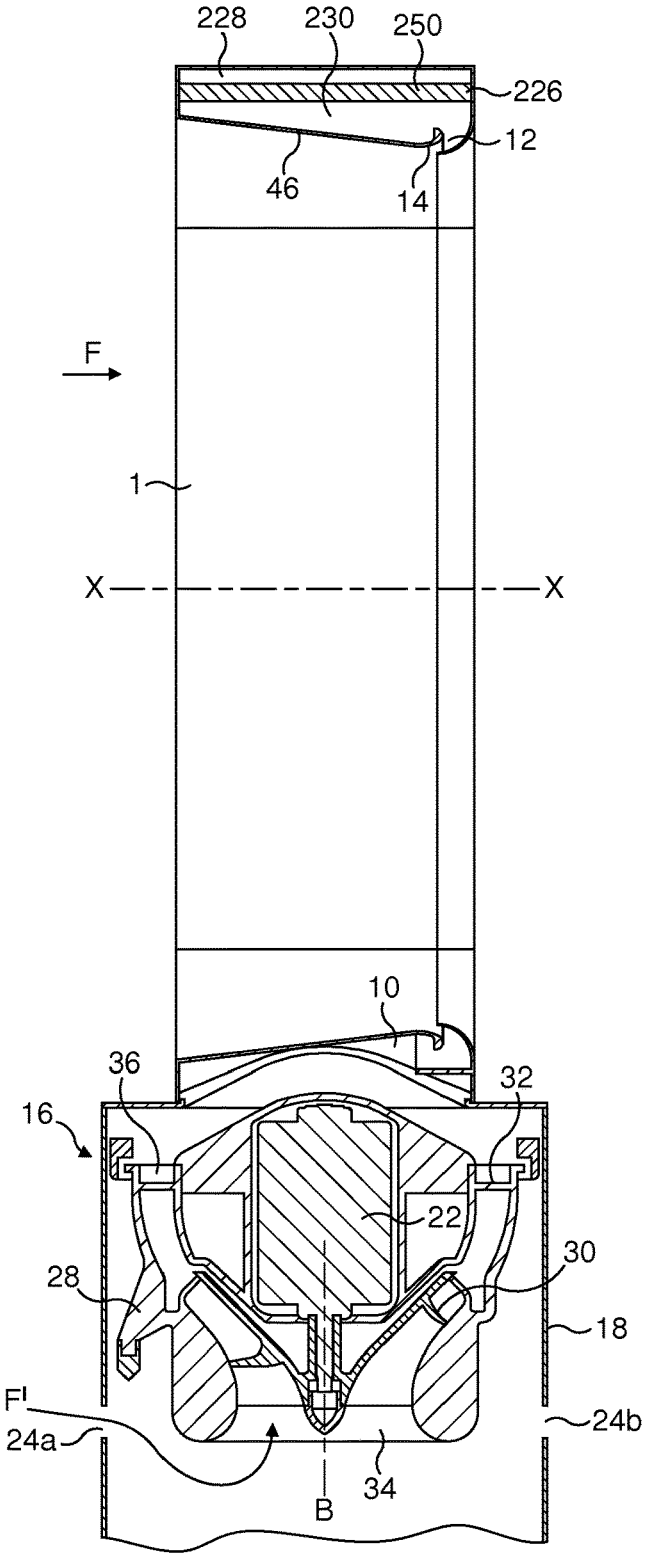
FIG. 7 is a side sectional view taken at line A-A through a portion of the fan assembly of FIG. 1, illustrating a third filter arrangement.
Figure 8:
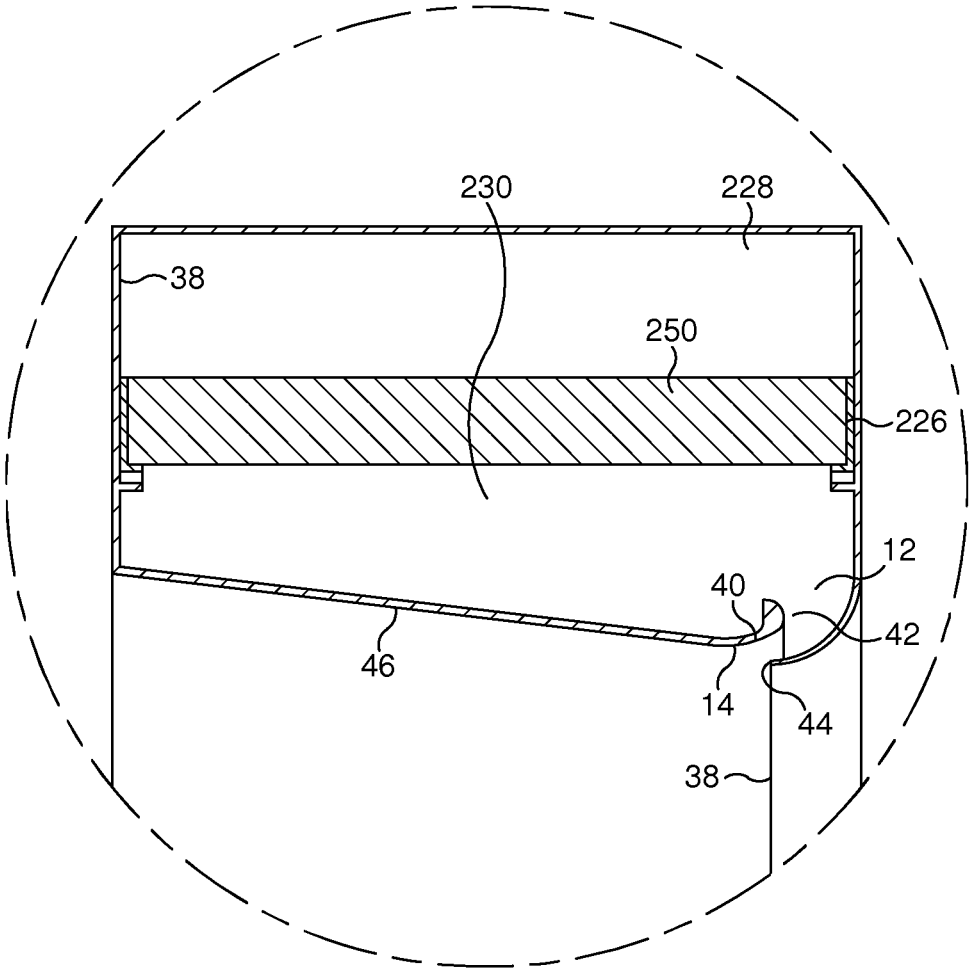
FIG. 8 is an enlarged side sectional detail of a portion of the fan assembly as illustrated in FIG. 7.

A third filter arrangement for the fan assembly 100 is illustrated in FIGS. 7 and 8. This third arrangement may be used in combination with, or separately from, any of the first and second filter arrangements. The third filter arrangement comprises a filter 226, which comprises a filter medium 250. The filter 226 is annular and is housed within the interior passage 10 of the nozzle 1 such that the filter 226 extends about the axis X. The filter 226 has a depth of around 5 cm in the direction of the axis X. The dimensions of the filter 226 are chosen so that the filter 226 is accommodated snugly within the nozzle 1. In a similar manner to the first and second filter arrangements, the filter 226 is preferably fixedly connected and secured within the interior passage 10 of the nozzle 1 by suitable fixings such as screw-threaded portions, fasteners, seal members or other equivalent means.

The interior passage 10 is divided by the filter 226 into an outer air chamber 228 and an inner air chamber 230. Each air chamber 228, 230 comprises a continuous duct or passageway within the nozzle 1. The outer air chamber 228 is arranged to receive the airflow from the base 16, and the inner air chamber 230 is arranged to convey the air flow to the mouth 12.

Thus, all of the air flow drawn into the nozzle 1 will enter the outer air chamber 228, pass through the filter medium 250 and into the inner air chamber 230 before exiting the nozzle 1 through the mouth 12. The filter 226 thus provides a post-motor filter in the fan assembly 100, and can thereby capture dirt and carbon debris that may be generated by motor brushes in a traditional motor or that may be drawn into the nozzle from outside the fan assembly.

In any of the above filter arrangements the filter may comprise one or any number of filters or filters assemblies in one or more locations within the fan assembly. For example, the shape and size of the filter and the type of filter material, may be altered. The filter material may comprise filter media such as foam materials, carbon, paper, HEPA (High Efficiency Particle Arrester) filter media, fabric or open cell polyurethane foam, for example. The filter material could be material having different density and thickness to that described and illustrated above. The filter may comprise a mesh or porous material located around the base and may form part of, or be mounted to, the outer casing. The filter may be suitable for removal of specific pollutants and particulates from the air flow and may be used for chemical or odor removal. Other filtration schemes or processing systems such as ionization or UV treatment could be used in any combination within the filter and within the fan assembly.

Also the manner in which the filter arrangement is received and located within the appliance is immaterial to this invention and a skilled reader will appreciate that the location can be formed by the mating of corresponding surfaces, push or snap fittings or other equivalent means. The filter may be positioned in or formed around any part of the fan assembly, it may be located adjacent or in close proximity to the air inlet, it may surround the entire circumference or boundary of the base, the motor or the motor housing. The shape and size of the portion of the fan assembly accommodating the filter may be modified.

The invention is not limited to the detailed description given above. Variations will be apparent to the person skilled in the art. For example, the fan could be of a different height or diameter. The performance of the fan assembly may be modified by increasing the diameter of the nozzle and the area of the mouth opening, the distance that the nozzle extends in the direction of the axis may be greater than 5 cm, and may be up to 20 cm. The fan need not be located on a desk, but could be free standing, wall mounted or ceiling mounted. The fan shape could be adapted to suit any kind of situation or location where a cooling flow of air is desired. A portable fan could have a smaller nozzle, say 5 cm in diameter. The means for creating an air flow through the nozzle can be a motor or other air emitting device, such as any air blower or vacuum source that can be used so that the fan assembly can create an air current in a room. Examples include a motor such as an AC induction motor or types of DC brushless motor, but may also comprise any suitable air movement or air transport device such as a pump or other means of providing directed fluid flow to generate and create an air flow. Features of a motor may include a diffuser or a secondary diffuser located downstream of the motor to recover some of the static pressure lost in the motor housing and through the motor.

Other shapes of nozzle are envisaged. For example, a nozzle comprising an oval, or 'racetrack' shape, a single strip or line, or block shape could be used. The fan assembly provides access to the central part of the fan as there are no blades. This means that additional features such as lighting or a clock or LCD display could be provided in the opening defined by the nozzle.

The outlet of the mouth may be modified. The outlet of the mouth may be widened or narrowed to a variety of spacings to maximize air flow. The Coanda effect may be made to occur over a number of different surfaces, or a number of internal or external designs may be used in combination to achieve the flow and entrainment required.

Other features could include a pivotable or tiltable base for ease of movement and adjustment of the position of the nozzle for the user.

The invention claimed is:

1. A fan assembly for creating an air current, the fan assembly comprising a nozzle that extends about an axis to define an opening through which air from outside the fan assembly is drawn by an air flow, a base connected to the nozzle, the base comprising a system for creating the air flow through the nozzle comprising a single air inlet, at least one base air inlet, and a filter surrounding the base and surrounding the system for creating the air flow for removing particulates from the air flow, the nozzle comprising an interior passage, a mouth for receiving the air flow from the interior passage, wherein the single air inlet to the system for creating the air flow is perpendicular to the at least one base air inlet.

2. The fan assembly of claim 1, wherein the filter is located upstream of the system for creating the air flow.

3. The fan assembly of claim 1, wherein an additional filter is located within the nozzle.

4. The fan assembly of claim 2, comprising an additional filter located downstream of the system for creating the air flow.

5. The fan assembly of claim 1, wherein the nozzle extends by a distance of at least 5 cm in the direction of the axis.

6. The fan assembly of claim 1, wherein the nozzle extends about the axis by a distance in the range from 30 cm to 180 cm.

7. The fan assembly of claim 1, wherein the nozzle comprises a loop.

8. The fan assembly of claim 1, wherein the nozzle is substantially annular.

9. The fan assembly of claim 1, wherein the nozzle is at least partially circular.

10. The fan assembly of claim 1, wherein the nozzle comprises a diffuser.

11. The fan assembly of claim 1, wherein the nozzle comprises at least one wall defining the interior passage and the mouth, and wherein said at least one wall comprises opposing surfaces defining the mouth.

12. The fan assembly of claim 11, wherein the mouth has an outlet, and the spacing between the opposing surfaces at the outlet of the mouth is in the range from 0.5 mm to 10 mm.

13. The fan assembly of claim 1, wherein the system for creating the air flow through the nozzle comprises an impeller driven by a motor.

14. The fan assembly of claim 13, wherein the system for creating the air flow comprises a DC brushless motor and a mixed flow impeller.

15. The fan assembly of claim 1, wherein the base comprises an air inlet and the filter is located upstream of the air inlet.

* * * * *